United States Patent [19]

Honma

[11] Patent Number: 4,481,506

[45] Date of Patent: Nov. 6, 1984

[54] PHOTOELECTRIC SMOKE SENSOR

[75] Inventor: Hiroshi Honma, Hino, Japan

[73] Assignee: Hochiki Kabushiki Kaisha, Tokyo, Japan

[21] Appl. No.: 357,712

[22] Filed: Mar. 12, 1982

[30] Foreign Application Priority Data

Mar. 18, 1981 [JP] Japan ..... 56-38903

[51] Int. Cl.[3] ..... G08B 17/10

[52] U.S. Cl. ..... 340/630; 250/574

[58] Field of Search ..... 340/630, 628; 250/574, 250/573; 356/338, 438, 439

[56] References Cited

U.S. PATENT DOCUMENTS 4,260,984 4/1981 Honma ..... 340/630

*Primary Examiner*—James L. Rowland
*Assistant Examiner*—Daniel Myer
*Attorney, Agent, or Firm*—Max Fogiel

[57] ABSTRACT

A photoelectric smoke sensor wherein a photo diode having a junction capacitance of 100 pH or less is employed and a resistor having a high resistance value of the order of mega-ohms is connected in series with the photo diode to obtain a photo output through the resistor, so that the voltage of the photo output may be sufficient to be directly subjected to comparison by the comparator without high-gain amplification even if the driving current for a light emitting diode is reduced. This enables omission of a high-gain amplifier and accordingly enables omission of a shield case for the circuits of the sensor which has been required to eliminate noises. Further this photoelectric smoke sensor is arranged so that the light emitting diode is driven intermittently, the photo output is compared with a reference voltage in synchronism with the driving of the light emitting diode, and the output from the comparator is data-read in by flip-flops at the timing of the decay of the photo pulse, to reduce the current consumption and simplify the circuit formation.

5 Claims, 10 Drawing Figures

PHOTOELECTRIC SMOKE SENSOR

BACKGROUND OF THE INVENTION

1. Field of the Invention

This invention relates to a photoelectric smoke sensor which detects light scattered by smoke entering a smoke sensing chamber and transmits a fire signal to a central signal station. More particularly, this invention relates to a photoelectric smoke sensor of this type which is capable of ensuring high reliability, reducing current consumption and lowering a manufacturing cost.

2. Description of the Prior Art

As a conventional photoelectric smoke sensor of the type as specified above, there has been practically used a photoelectric smoke sensor as illustrated in a block diagram of FIG. 1.

In FIG. 1, numeral 1 designates a diode bridge circuit which is provided to obtain an output of a desired polarity irrespective of a change in the connection polarity of power and signal lines $1_1$, $1_2$ leading to a central signal station. Following the diode bridge circuit 1, there are provided a switching circuit 2 including a thyristor which short-circuits between the power and signal lines $1_1$, $1_2$ to transmit a fire signal upon detection of a fire, a constant voltage circuit 3 having a current limiting function, an oscillator circuit 4 including a pulse control circuit, a light emitting diode 5 which is intermittently driven in response to a pulse signal from the oscillator circuit, a photo diode 7 which is reversely biased and conducts upon receipt of light scattered by smoke entering a smoke sensing section 6, a comparator circuit 8 which generates an output when a photo voltage obtained upon conducting of the photo diode 7, and a storage circuit 9 which outputs a fire detection signal to energize the switching circuit 2 when two successive outputs are obtained from the comparator circuit 8.

The circuit arrangement as described above has now been standard in the photoelectric smoke sensor. In this circuit arrangement, to reduce a current consumption, not only the light emitting diode 5 is intermittently driven by pulses, but the comparator circuit 8 is intermittently supplied with power from the oscillator circuit 4 in synchronism with the driving of the light emitting diode 5 to operate the comparator circuit 8 only during a period when pulsed light is output. CMOS is used as devices in the circuits to curtail the entire current consumption of the smoke sensor.

In this connection, it is to be noted that the current most consumed in the circuit arrangement of FIG. 1 is a current used to drive the light emitting diode 5 and it reaches 50% of the entire current consumption.

Therefore, it is most effective to reduce a driving current for the light emitting diode 5 to curtail the entire current consumption. However, if the driving current is reduced, the scattered light incident on the photo diode 7 from the smoke detecting section 6 is also reduced and the photo voltage is lowered.

To solve this problem, as the comparator circuit 8, there has been used a comparator circuit as illustrated in FIG. 2 in which a load resistor $R_o$ of several-hundred kilo-ohms is connected in series with the photo diode 7 which is reversely biased with reference to a power source, and a voltage developed across the load resistor $R_o$ by a photo current which flows when the photo diode 7 detects the light scattered by smoke is amplified by an amplifier 11 including an operational amplifier or a transistor amplifier circuit having a gain as high as 500 to 1,000 times to turn on a transistor when the amplification output exceeds about 0.6 V of a base-emitter voltage of the transistor Tr; a comparator circuit as illustrated in FIG. 3 in which a load resistor $R_o$ of several-hundred kilo-ohms is connected in parallel with the photo diode 7, the photo voltage obtained upon detection of the scattered light by smoke is detected in the form of a voltage developed across the load resistor $R_o$, and amplified by an amplifier 11 which is comprised of an operational amplifier or a transistor amplification circuit having a gain as high as 500 to 1,000 times to turn on a transistor Tr when the amplification output exceeds about 0.6 V of base-emitter voltage of the transistor, or a comparator circuit as illustrated in FIG. 4 in which a comparator 12 which compares an output of the amplifier 11 with a reference voltage Vr is employed.

Alternatively, as disclosed in U.S. Pat. No. 4,186,390, a photo diode is connected between an inverting terminal and a non-inverting terminal of an operational amplifier to amplify, with a high gain, a photo current obtained by short-circuiting therebetween, a transistor circuit is provided to decide whether the output of the operational amplifier reaches a level corresponding to a predetermined smoke density, and an alarm circuit is actuated through a logical circuit comprised of flip-flops.

In the arrangements as shown in FIGS. 2 and 3 and as disclosed in U.S. Pat. No. 4,186,390, a low-cost, two-power source operational amplifier or a transistor amplification circuit including two or three transistors is employed, and to reduce the current consumption by the amplifier, a micropower type two-power source operational amplifier is used in case the operational amplifier is employed and transistors having a high d.c. amplification are Darlington connected and a resistance at the collector or emitter side of the transistor is high to reduce a collecter current at a normal condition in case the transistor amplification circuit is employed.

Or, a common operational amplifier, i.e., an operational amplifier whose current consumption is several milli-amperes may be employed. In this case, to reduce current consumption by the amplifier, a power source is connected to the operational amplifier about several milli-seconds before the driving of the light emitting diode so that the light emitting diode is driven after the operation of the operational amplifier becomes stable, and a power source is disconnected when the driving of the light emitting diode is finished. This idea is disclosed, for example, in U.S. Pat. No. 4,198,627.

With these special arrangement for curtailing the current consumption, the conventional smoke sensor has successfully attained reduction of the average current consumption of the entire system at a normal supervisory condition (a condition where no fire signal is generated) to about 100μA. The specifications of the current consumption are as follows:

(a) constant voltage circuit 3: about 2 to 5μA
(b) driving current of light emitting diode 5: about 40 to 60μA
(c) oscillator circuit 4: about 5 to 10μA
(d) amplifier 11 of comparator circuit 8: about 15μA
(e) storage circuit 9: about 5 to 10μA
(f) leakage current of device: about 5 to 10μA However, in the case of a system as illustrated in FIG. 2 wherein a photo voltage of several milli-volts is amplified by the amplifier, the comparator circuit 8 generates an inverting output and causes an erroneous operation by a noise as small as 1 mV which is occasionally produced by electromagnetic induction or electrostatic induction. In the case of a system wherein the two-power source operational amplifier is employed, a power voltage in divided by a zener diode or a dividing resistor to obtain a middle point potential. To suppress a current consumption by the zener diode or the dividing resistor, they should be of high impedance and the potential is liable to be fluctuated by noises, possibly causing an erroneous operation.

By this reason, in the conventional smoke sensors, the entire circuit is encased in a shield case 10 as shown by a broken line in FIG. 1 to prevent an erroneous operation by an external noise.

However, even if the circuit is fully shielded by the shield case 10, erroneous operations cannot always be prevented and they will occasionally be caused by an induction noise superimposed in the power and signal lines $1_1$, $1_2$ because the circuit is connected to the central signal station via the power and signal lines $1_1$, $1_2$. In addition, a shield case which has a sufficient shielding effect is too expensive. Thus, there has not been provided yet a smoke sensor which can satisfy all the requirements of high reliability, low current consumption and low manufacturing cost.

OBJECTS OF THE INVENTION

It is a first object of the present invention to provide a photoelectric smoke sensor which is capable of directly obtaining a large photo output by employing a photo diode having a junction capacitance of 100 pF or less as a photoelectric means which receives pulsed light from a light emitting diode which is scattered by smoke and capable of simplifying a circuit formation of a comparator circuit, enhancing the reliability of the sensor and reducing the current consumption, by comparing the photo output directly by the comparator without amplifying the photo output with a high gain.

It is a second object of the present invention to provide a photoelectric smoke sensor which is capable of remarkably improving S/N ratio by directly obtaining a large photo output from a photo diode, thereby to enable a shield case to be omitted and the manufacturing cost to be reduced.

It is a third object of the present invention to provide a photoelectric smoke sensor wherein an output of a comparator circuit obtained in synchronism with a light emitting pulse is data-read in by flip-flops at a timing of the decay of the light emitting pulse (the trailing edge of the pulse) to enhance the stability of the data reading-in operation at the time of intermittent power supply, reduce the current consumption and simplify the circuit formation.

SUMMARY OF THE INVENTION

In accordance with the present invention, there is provided a photoelectric smoke sensor including a light emitting diode which is driven intermittently to emit light and irradiated pulsed light to a smoke sensing chamber when smoke enters the chamber, a photo diode which receives the light scattered by smoke entering the smoke sensing chamber and converts the received light into an electrical signal, a comparator which is supplied with power in synchronism with the driving of the light emitting diode, receives an output signal from the photo diode at one input terminal thereof through a differentiating circuit, receives a predetermined reference voltage at another input terminal thereof in synchronism with the driving of the light emitting diode and generates an output when the output voltage of the differentiating circuit reaches and exceeds the predetermined reference voltage, a storage circuit which stores the output from the comparator and generates an output when two successive outputs from the comparator are input thereto, and a switching circuit which conducts to short-circuit power and signal lines leading to a central signal station and transmit a fire signal, which sensor is characterized in that said photo diode has a junction capacitance of loo pF or less and is connected in series with a resistor having a high resistance value of the order of megohms, and a voltage signal appearing at the resistor is input, as said output from the photo diode, to the comparator through the differentiating circuit.

DESCRIPTION OF THE EMBODIMENTS

Figure 1:
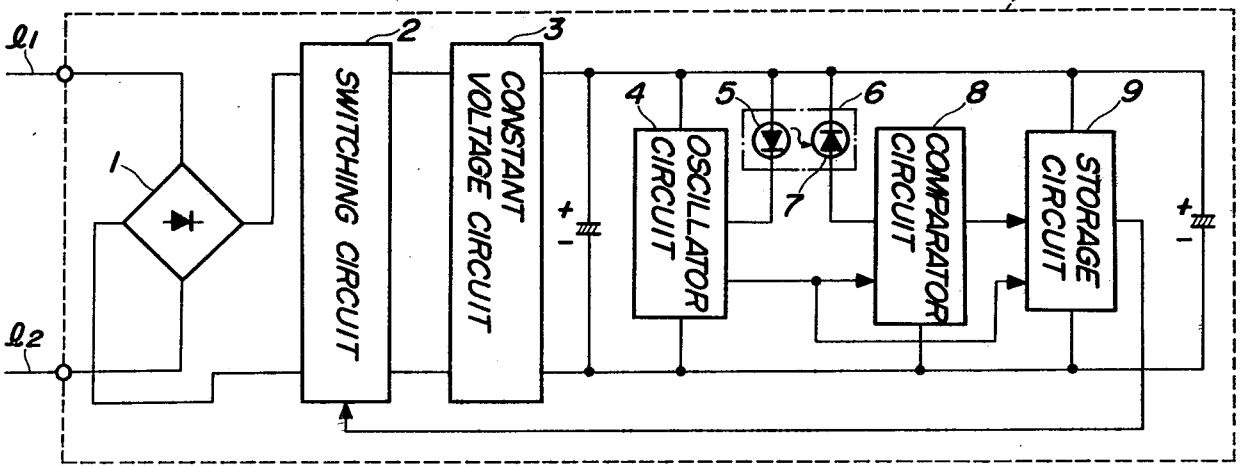
FIG. 1 PRIOR ART
FIG. 1 is a block diagram of one example of conventional photoelectric smoke sensor.
Figure 2:
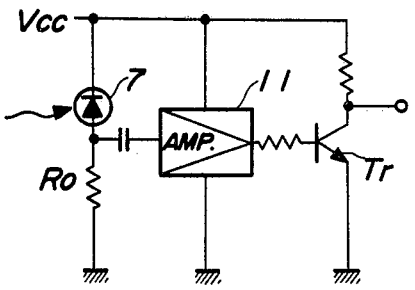
FIG. 2 PRIOR ART
FIGS. 2 to 4 are circuit diagrams each showing a concrete formation of a two-power source comparator circuit employed in the conventional smoke sensor.
Figure 3:
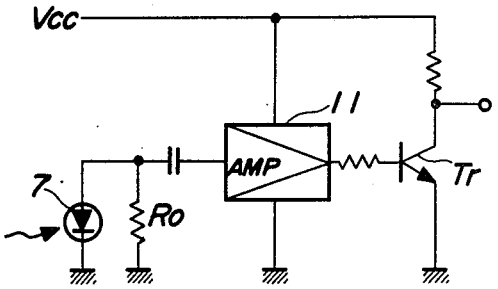
FIG. 3 PRIOR ART
Figure 4:
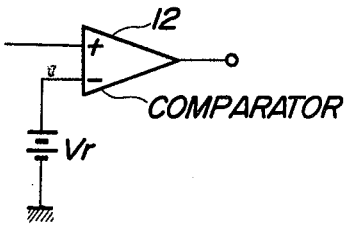
FIG. 4 PRIOR ART
Figure 5:
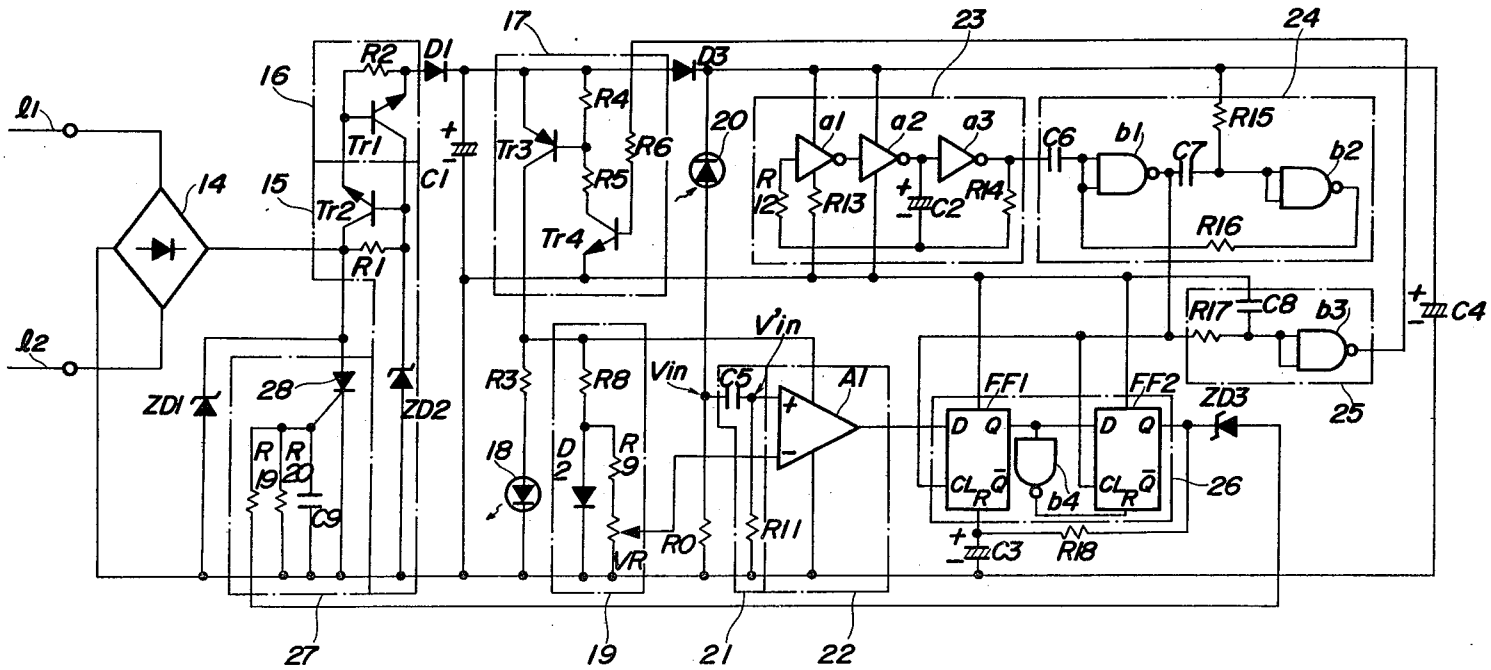
FIG. 5 is a circuit diagram of a first embodiment of a photoelectric smoke sensor according to the present invention.

FIG. 5 illustrates a circuit arrangement of a first embodiment of a photoelectric smoke sensor according to the present invention.

In the circuit of the photoelectric smoke sensor illustrated in FIG. 5, a diode bridge circuit 14 is connected to power and signal lines $1_1$, $1_2$ leading to a central signal station (not shown). This diode bridge circuit 14 is so formed that it outputs a voltage of a desired polarity irrespective of the connection polarities of the power and signal lines $1_1$, $1_2$, and supplies a power to a switching circuit 27 having a switching element, i.e., a thyristor 27, a zener diode $ZD_1$ for overload protection and a constant voltage circuit 15. The zener diode $ZD_1$ has a function as a surge absorbing element and protects the switching circuit 27 etc. from a noise induced in the power and signal lines $1_1$, $1_2$ and a surge noise.

A fire alarm indicating lamp circuit (not shown) is connected to the power and signal lines $1_1$, $1_2$ leading to the central signal station, at an input side of the diode bridge circuit 14. The fire alarm indicating lamp circuit operates to light a fire alarm indicating lamp provided on each of fire detectors when a fire signal is transmitted.

The constant voltage circuit 15 regulates an output voltage of the diode bridge circuit 14, for example, of about 22V to about 13V by a constant voltage control operation by a transistor $Tr_2$, based on a reference voltage determined by a zener diode $ZD_2$. A current limiting circuit 16 having a transistor $Tr_1$ limits a load current flowing when a power source is connected, so as not to exceed for example 160μA.

An electrolytic capacitor $C_1$ is connected to an output of the current limiting circuit 16 through a diode $D_1$. The electrolytic capacitor $C_1$ supplies power to circuits in the following stages.

The circuits which are supplied with power from the capacitor $C_1$ are a light emission drive circuit 17 for intermittently driving a light emitting diode 18, a reference voltage setting circuit 19 for setting a comparing reference voltage Vr, a differentiating circuit 21 for differentiating an output from a photo diode 20, a comparator circuit 22 for comparing the output from the photo diode obtained through the differentiating circuit 21 with the reference voltage Vr, an oscillator circuit 23 for outputting rectangular pulses having a duty cycle of 50% by periods of about 4 to 6 seconds, a pulse control circuit 24 for outputting, in response to the oscillated pulses, light emission control pulses of a predetermined pulse width to the light emission drive circuit 17 through a delay circuit 25, and a storage or latch circuit 26 for producing for a switching circuit 27 a high-level output (hereinafter referred to as "H-level output") when two H-level outputs are successively obtained from the comparator circuits 22.

Each of the circuits which are supplied with power from the capacitor $C_1$ will now be described in detail. The oscillator circuit 23 is comprised of an astable multiple vibrator having three stages of inverters $a_1$, $a_2$ and $a_3$ formed of CMOS IC. The current consumption of the inverter $a_1$ is restricted by a resistor $R_{13}$ so as to suppress the current consumption of the entire oscillator circuit to about 10μA. The oscillation period of the oscillator circuit 23 is about $2.2R_{14}\cdot C_2=4$ to 6 sec which is determined by a resistor $R_{14}$ and a capacitor $C_2$.

The pulse control circuit 24 is a monostable multiple vibrator which is comprised of inverters $b_1$ and $b_2$ formed of CMOS IC, resistors $R_{15}$ and $R_{16}$ and capacitors $C_6$ and $C_7$. This monostable multiple vibrator has a function to compensate for a variation in an output pulse width which is possibly caused due to a difference in threshold voltages between CMOS IC's employed. The monostable multiple vibrator is triggered by the rise of the pulse output from the oscillator circuit 23 and outputs, from an output of the inverter $b_1$, a control pulse having a pulse width (less than 200μsec) determined by a time constant of about $1.55R_{15}\cdot C_7$.

The delay circuit 25 is comprised of an inverter $b_3$ of CMOS IC, a resistor $R_{17}$ and a capacitor $C_8$. This delay circuit 25 applies to the light emission drive circuit 17 the output pulse from the pulse control circuit 24 after a delay corresponding to a time constant of about $0.69R_{17}\cdot C_8$.

The light emission drive circuit 17 comprises transistors $Tr_3$ and $Tr_4$ which are turned on by the output pulse from the delay circuit 25. The light emitting diode 18 is connected to the collector of the transistor $Tr_3$ through a resistor $R_3$. The light emission drive circuit 17 drives the light emitting diode 18 and at the same time supplies power to the reference voltage setting circuit 19 and the comparator circuit 22. As the light emitting diode 18, there is employed a common infrared ray light emitting diode having a high light emission efficiency.

The photo diode 20, which receives light scattered by smoke enterring a smoke sensing section (not shown) when the pulsed light from the light emitting diode 18 is incident on the smoke sensor section, is biased reversely by being connected in series to a resistor $R_0$ of a high resistance value. It is preferred that the photodiode 20 has a junction capacitance of 100 pF or less. As a photodiode 20 having a junction capacitance of 100 pF or less, there may preferably be employed a PIN type photo diode. The junction capacitance of the PIN type photo diode is as low as 20 to 60 pF. The photo current flowing when the photo diode receives light is usually of several-ten nano-seconds.

To obtain a high voltage Vin by the circuit as described above when light is received, in general, the resistance value of the resistor $R_0$ connected to the photo diode 20 may be increased. However, in case a pulsive light is received, the rise-time constant of the voltage Vin corresponds to a time constant determined by the juction capacitance of the photo diode 20 and the resistance value of the resistor $R_0$. Therefor, when the pulsive light is as short as about 200μsec or less, the voltage Vin cannot sufficiently rise within the pulse width of the light in case of a photo diode having a junction capacitance of 100 pF or more, unless the load resistor $R_0$ has a resistance value of several kilo-ohms. By this reason, when the photo diode having a junction capacitance of 100 pF or more is used, the voltage Vin is as low as several milli-volts because the resistance value of the resistor $R_0$ is not so large in the conventional systems. In accordance with the present invention, the resistance value of the resistor $R_0$ may be several megohms, for example, larger than 1MΩ to 5MΩ by using a photo diode having a junction capacitance of 100 pF or less. As a result, the voltage Vin can be increased to more than several ten milli-volts.

The reference voltage setting circuit 19 divides about 0.6V of forward voltage of a diode $D_2$ by a variable resistor VR to obtain the reference voltage Vr. The reference voltage setting circuit 19 is supplied with power to generate the reference voltage Vr only when the transistor $Tr_3$ of the light emission drive circuit 17 is turned on. The reason why the forward voltage of the diode $D_2$ is divided to obtain the reference voltage Vr is to compensate for a change in characteristics of the light emitting diode 18 and the photo diode 20 which may be caused by variation in ambient temperature. More specifically, the light emitting diode 18 and the photo diode 20 each have a temperature characteristic determined by the characteristics of devices employed. The temperature characteristics of the light emitting diode 18 and the photo diode 20 are opposite to each other and cancelled with each other due to the connection polarities thereof. However, the variation in the characteristic of the light emitting diode 18 is larger than that of the photo diode 20.

Therefore, the output from the photo diode 20 is lowered when a temperature is high and it is increased when a temperature is low. And, if the reference voltage Vr is fixed, the sensitivity of the smoke sensor is lowered as the temperature rises. By this reason, the reference voltage Vr is lowered by the diode $D_2$ as the temperature rises to always assure a desired sensitivity. A resistor $R_9$ is provided to improve the resolution of the variable resistor VR, but it may be omitted.

The comparator circuit 22 includes a comparator $A_1$ which generates a H-level output when a photo voltage Vin' (differentiated voltage of Vin) obtained through the differentiating circuit 21 is higher than the reference voltage Vr. It is necessary that the comparator $A_1$ have a sufficiently high input impedance with reference to the resistor $R_0$ which is a load of the phto diode 20, the input offset voltage and input offset current be sufficiently small with reference to an input signal and the comparator $A_1$ be able to operate by a single power source. It suffices that the amplification gain of the comparator $A_1$ be more than 100 times which is an ordinary amplification gain of the most simple operational amplifier. In effect, an operational amplifier having MOS-FET in the input stage and having a high input impedance is employed.

The comparator $A_1$ of this type can be used owing to the fact that the photo voltage Vin obtained by the resistor $R_0$ is as high as several-tens milli-volts. In other words, as different from the conventional senser which is capable of obtaining a photo voltage of only several milli-volts, it is not necessary to use two power sources on the basis of the middle point potential. By this reason, the circuit arrangement can be simplified and the operation of the circuit can be more stable. Besides, an offset adjusting circuit for improving the resolution of the comparator can be omitted.

The differentiating circuit 21 cuts off an output by a dark current Id of the photo diode 20. For example, when the dark current Id=1nA, the resistance value of the resister $R_0=1M\Omega$, a voltage of 1mV appears accross the resistor $R_0$, and this voltage output is cut off by the differentiating circuit 21 is not input to the comparator circuit 22.

The storage circuit 26 comprises two stages of D flip-flops $FF_1$ and $FF_2$ and an inverter $b_4$ of CMOS IC. The output pulse from the pulse control circuit 24 is input to clock terminals CL of the respective D flip-flops $FF_1$ and $FF_2$. The output of the comparator $A_1$ of the comparator circuit 22 is connected to a terminal D of the D flip-flop $FF_1$ so as to be input thereto, and a terminal Q of the D flip-flop $FF_1$ is connected to a terminal D of the D flip-flop $FF_2$ of the second stage. A terminal Q of the D flip-flop $FF_2$ is connected to the switching circuit 27 through the zener diode $ZD_3$ for protection against erroneous operation. This storage circuit 26 is so formed that only when two successive H-level outputs are obtained from the comparator circuit 22 in synchronism with the output pulse of the pulse control circuit 24, the terminal Q of the flip-flop is put into an H-level to conduct the thyristor of the switching circuit 27. Although the terminal Q of the first-stage flip-flop $FF_1$ is connected to a terminal R (rest terminal) of the second-stage flip-flop $FF_2$ through the inverter $b_4$ in the circuit arrangement illustrated in FIG. 5, the terminal Q of the first-stage flip-flop $FF_1$ may be connected directly to the terminal R of the succeeding flip-flop $FF_2$.

A capacitor $C_3$ and the resistor $R_{18}$ connected to the storage circuit 26 constitute a delay circuit, and if the terminal Q of the second-stage flip-flop $FF_2$ becomes high, the first-stage flip-flop $FF_1$ is reset after a predetermined time delay.

The zener diode $ZD_3$ is provided to prevent the terminal Q of the D flip-flop $FF_2$ from becoming high under unstable conditions immediately after power supply, so as not to erroneously operate the thyristor. The zener diode $ZD_3$ shuts off the output from the storage circuit 26 until a normal operation voltage of the storage circuit 26 corresponding to the zener voltage of the zener diode $ZD_3$ is obtained.

The operation of the smoke sensor illustrated in FIG. 5 will now be described.

First, referring to a time chart of FIG. 6, the operation of the smoke sensor from the power supply to normal supervisory operation will be described.

Assuming that the central signal station is powered on at the time $t_1$, a power source voltage is applied, through the power and signal lines $\mathbf{1}_1$, $\mathbf{1}_2$, to the circuits, and the capacitor $C_1$ starts charging through the diode bridge circuit 14 and the constant voltage circuit 15 by a current determined by the current limiting circuit 16.

If the voltage at the terminal of the capacitor $C_1$ reaches, at the time $t_2$, a predetermined value, for example, about 13V, which is determined by the constant voltage circuit 15, the oscillator circuit 23 is driven to output rectangular pulses having a duty cycle of about 50% with an oscillation period $T_0=3.5$ sec to the pulse control circuit 24. The pulse control circuit 24 is triggered in synchronism with a rise of the oscillated pulse to the H-level, and after a time delay corresponding to a time constant of about $1.55R_{15}\cdot C_7$ which is determined by the capacitor $C_7$ and the resistor $R_{15}$, a control pulse having a pulse width of 200μsec or less is generated at the output side of the inverter $b_1$. The delay circuit 25 applies the control pulse to the base of the transistor $Tr_3$ of the light-emission drive circuit 17 after a time delay corresponding to a time constant of about $0.69R_{17}\cdot C_8$ to turn on the transistors $Tr_3$ and $Tr_4$. The control pulse is further applied directly to the terminals CL of the respective D flip-flop $FF_1$ and $FF_2$ of the storage circuit 26.

When the transistor $Tr_3$ of the light-emission drive circuit 17 is turned on, a driving current flows to the light emitting diode 18 to light the diode 18 and irradiate pulsed light having a predetermined period with a light emission duration of 200μsec or less.

On the other hand, upon the conducting of the transistor $Tr_3$, power is supplied to the reference voltage generating circuit 19 and the comparator circuit 22 to generate the reference voltage during the period when the transistor $Tr_3$ conducts, so that the comparator $A_1$ of the comparator circuit 22 is rendered operative to carry out the comparison operation. The comparator $A_1$ has a delay of about 60μsec between the time when power is supplied and the time when the operator $A_1$ is put into a desired operational condition, and so, the pulse width of the light emission pulse may be selected as 60μsec or more.

At this time, since no smoke enters the smoke sensing chamber, there is no scattered light by smoke incident on the photo diode 20 and the light only reaches the photo diode after several reflections against a wall of the smoke sensing chamber. As a result, there flows a photo current as small as several nanoamperes which is due to a slight amount of reflected light incident on the photo diode 20 and a dark current. But if the resistance value of the resistor $R_0$ is $1M\Omega$, a voltage of only several milli-volts is generated at the resistor $R_0$. Since this voltage is sufficiently small as compared with the reference voltage Vr, i.e., several-ten millivolts, the output of the comparator $A_1$ is maintained low.

The control pulse applied to the storage circuit 26 puts the clock terminals CL of the D flip-flops $FF_1$ and $FF_2$ into H-level to enable the storage circuit 26 to read in data, i.e., to be set. But, since an H-level output is not applied from the comparator circuit 22 during the time when the terminals CL are at H-level, the D flip-flops $FF_1$, $FF_2$ are reset, and the output from the storage circuit 26 is maintained low.

Figure 6:
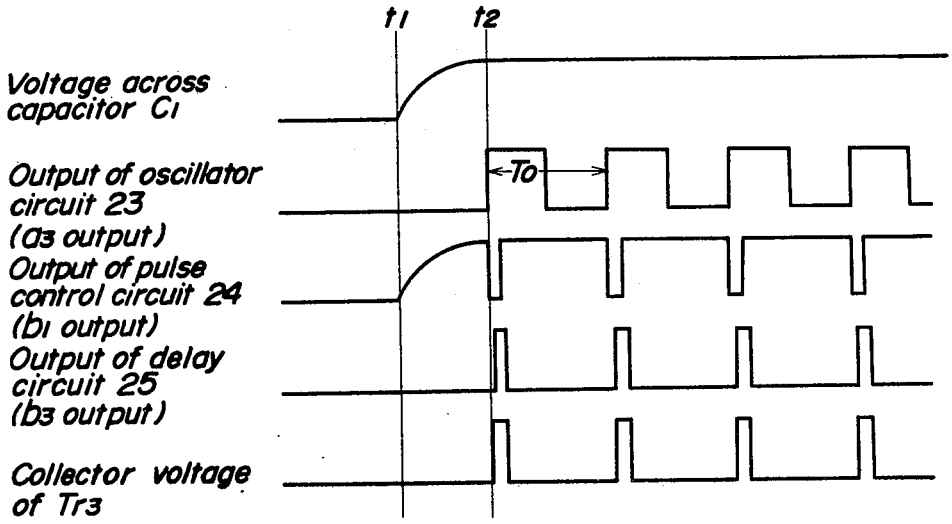
FIGS. 6 and 7 are time charts each showing the operation of the photoelectric smoke sensor illustrated in FIG. 5.
Figure 7:
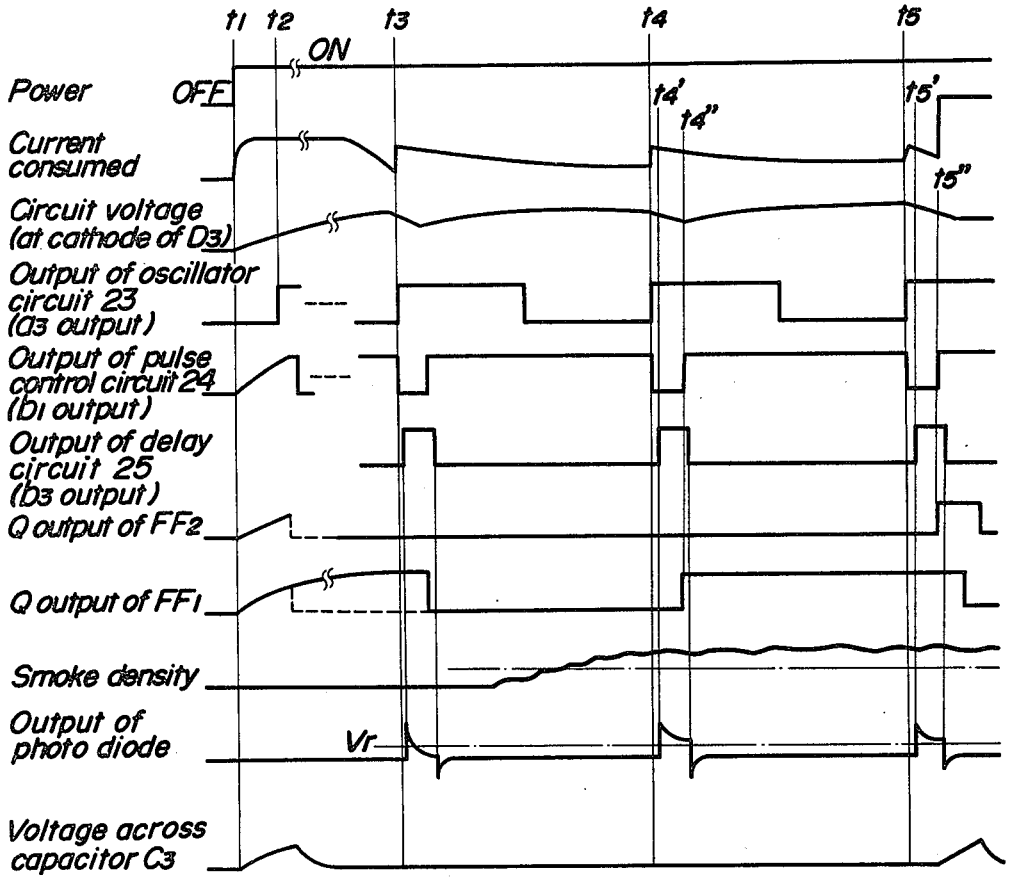

FIG. 7 shows a time chart for showing a fire detecting operation in addition to the operation during the time $t_1$ and $t_2$ of FIG. 6.

For example, it is assumed that a fire starts and smoke begins to enter the smoke sensing chamber between the time $t_3$ and $t_4$ when the output of the oscillator circuit 23 rises to an H-level and the smoke density reaches, at the time $t_4$, the predetermined level corresponding to the level to generate a fire alarm.

Under these conditions, the output of the oscillator circuit 23 is put into an H-level at the time $t_4$ to trigger the pulse control circuit 24, and a control pulse is applied to the light emission driving circuit 17 through the delay circuit 25 at the time $t_4'$. Upon conducting of the transistors $Tr_4$ and $Tr_3$, the light emitting diode 18 is driven so that scattered light diffusedly reflected by particles of the smoke entering the smoke sensing chamber is incident on the photo diode to conduct the same.

The scattered light is received during the period of 200μsec or less when the light emitting diode 18 is driven. In case the junction capacitance of the photo diode 20 is 20 pF and the resistance value of the resistor $R_0$ is 1MΩ, the time constant tr for rising of the photo voltage generated at the resistor $R_0$ is $1M\Omega \times 20pF = 20\mu sec$. In this case, if the capacitance of the capacitor $C_5$ of the differentiating circuit 21 is 0.001μF and the resistance value of the resistor $R_{11}$ is 4.7MΩ, the time constant $\tau$ of the differentiating circuit 21 is 4.7 milli-sec. Therefore, the change in the photo voltage Vin generated at the resistor $R_0$ appears across the resistor $R_{11}$ of the differentiating circuit 21, as it is, without being attenuated, and is applied to the comparator circuit 22.

Thus, the driving time of the light emitting diode 18 may be shortened to 20μsec. However, since it takes about 60μsec for the comparator $A_1$ to be put into the stable operating condition after the power supply thereto. Therefore, the driving time of the light emitting diode 18 should be at least 80μsec due to such a delay in operation to put the circuit into practical use. Although the width of the driving pulse for the light emitting diode 18 may be reduced from the 200μsec to 80μsec, the width is selected in the circuit of this embodiment, as about 155μsec which is about twice of 80μsec with a sufficient allowance.

On the other hand, when the resistance value of the resistor $R_0$ is selected as 1 to 5MΩ, in general, several ten nano-amperes of photo current is obtained by the photo diode 20. And, several ten milli-volts of photo voltage Vin is obtained when the resistance value of the resistor $R_0$ is 1MΩ. However, the load risistance value has a limit, because the output is not substantially increased with increase in the load resistance value in a saturation range of the photo detector.

The photo voltage Vin is input, substantially as it is, to the comparator circuit 22 through the differentiating circuit 21 and subjected to comparison with the reference voltage Vr. If the reference voltage Vr is 50mV and the amplification gain of the comparator $A_1$ is 1,000 times, 33 the H-level output from the comparator $A_1$ is $(Vin - Vr) \times 1{,}000 = 10$ V when the photo voltage Vin is 60mV. Thus, an inverting output higher than the threshold level (½ of the power voltage) of the CMOS logical circuit can be obtained directly.

When the comparator circuit 22 generates an H-level output at the time $t_4'$, the D flip-flop $FF_1$ of the storage circuit 26 is set to generate an H-level output at the terminal Q by a rise of the control pulse (output of $b_1$) at the time $t_4''$ immediately before the ending of the light emission by the light emitting diode 18. The so set D flip-flop $FF_1$ holds it set condition unless a reset input is applied thereto or a clock signal is applied when the terminal D is at an L-level.

When an H-level output is generated from the comparator circuit 22 at the time $t_5$, $t_5'$ and the clock terminals CL rises to the H-level by the control pulse (output of $b_1$) at the time $t_5''$ immediately before the ending of the light emission by the light emitting diode 18, the D flip-flop $FF_2$ is set and an H-level output from the terminal Q thereof is applied to the switching circuit 27 through the zener diode $ZD_3$ to render the thyristor 28 conducting.

Upon this conducting of the thyristor 28, the power and signal lines $1_1$, $1_2$ are short-circuited through the fire alarm indicating lamp circuit 13 and the diode bridge circuit 14. As a result, a current flowing through the power and signal lines $1_1$, $1_2$ are increased so as to allow a fire signal to be transmitted to the central signal station. When the Q output of the D flip-flop $FF_2$ becomes high, the capacitor $C_3$ is charged through the resistor $R_{18}$. When the voltage developed across the capacitor $C_3$ exceeds ½ of the power voltage, the D flip-flop $FF_1$ is reset. At the same time, the D flip-flop $FF_2$ is also reset by an H-level output from the inverter $b_4$. Thus, the D flip-flops $FF_1$ and $FF_2$ are reset into their original conditions. Thus, the time during which the D flip-flop $FF_2$ generates an H-level output is determined by a time constant of about $0.69R_{18} \cdot C_3$, and the time may, for example, be about 78 msec which is sufficient to conduct the thyristor 28.

On the other hand, if the D flip-flop $FF_1$ of the storage circuit 26 is set at the time between $t_4$ and $t_4''$ and the comparator circuit 22 does not generate an H-level output during the time between $t_5$ and $t_5''$, the terminal D of the D flip-flop $FF_1$ is at an L-level when the control pulse (output from $b_1$) rises at the time $t_5''$ and the D flip-flop $FF_1$ reads in the L-level input so that the terminal Q of the flip-flop $FF_1$ is put into an L-level. The Q output of L-level, in turn, renders the output of the inverter $b_4$ high and reset the D flip-flop $FF_2$. Thus, the storage is cancelled.

The reduction in the current consumption which is enabled by the present embodiment will now be described referring to the comparator circuit 22 including the reference voltage setting circuit 19.

If the power voltage Vcc is 12V, the current consumed by the reference voltage setting circuit 19 and the comparator circuit 22 will be 8.45mA because the current consumption by the operational amplifier constituting the comparator $A_1$ is 3mA and the current consumption by the reference voltage setting circuit 19 is 5.45mA (=12V/2.2KΩ) determined by the resistance value (2.2KΩ) of the resistor $R_8$. In this connection, it is to be noted that the reference voltage setting circuit 19 and the comparator circuit 22 are intermittently operated once per 3.5 sec. Therefore, the average current consumption will be:

$$8.45mA/(3.5sec/155\mu sec) = 0.37\mu A$$

This value is less than 1/40 of the current consumption (15μA) by the conventional comparator circuit and amplifier.

In addition, it takes about several-milli-seconds for the conventional comparator which effects amplification with a gain as high as 500 to 1,000 times by the pulsed power source, to be put into a stable operational condition after the supply of power. This requires that the power be supplied to the amplifier before the initiation of the driving of the light emitting diode. In contrast, according to the present invention, it takes only 155μsec for the comparator circuit of the present invention to become stabilized, and driving current for the light emitting diode 18 can be largely reduced as compared with that of the conventional circuit. Thus, the current consumption of the entire system can be reduced very much.

Furthermore, while the photo output generated at the resistor connected in series with the photo diode in the conventional smoke sensor is about several milli-volts, the photo output obtained in the present invention is as high as several-ten milli-volts to several-hundred milli-volts. This enables substantial omission of offset adjustment and remarkable improvement in the S/N ratio. In other words, while the amplification with high gain is effected in the comparator circuit of the conventional smoke sensor to obtain an output of 0.5 to 1V, it suffices in the present invention to amplify the photo output with a low gain such as 5 to 10 times to obtain an H-level output of 0.5 to 1.0 V. Thus, the gain of the amplifier can be lowered to 1/10 to 1/100 as compared with the conventional smoke sensor. This means that when a noise is applied, 10 to 100% of error is caused to possibly transmit a fire alarm signal in the conventional smoke sensor, but only 1 to 10% of error is caused in the present invention.

Although the base-emitter voltage of the transistor is used as a threshold voltage to detect a fire signal in the example as described above, the conclusion can also be applied to the case where an operational amplifier having a gain of 1,000 times or more is employed as a comparator.

More particularly, as described above, the conventional system obtains 0.5 to 1.0V of output by using an amplifier of a gain as high as 500 to 1,000 times, and the level of the photo signal obtained upon detection of smoke is around 1mV. To subject such a small photo signal to direct comparison by a comparator as in the present invention, the resolution of the comparator should be several micro-volts to several-ten micro-volts to effect accurate comparison with the reference voltage Vr. Therefore, the gain of the comparator should be about 100,000 times. In addition, the input offset voltage and the offset current should be lower than the photo signal level. Furthermore, since an erroneous fire signal is produced by a noise of about 10μV, a complicated noise eliminating circuit and a highly precise and costly comparator should be employed.

In contrast, according to the present invention, an ordinary comparator having a gain of 1,000 times or more, an input offset voltage of several milli-volts and an input offset current of several pico-amperes may be employed without specific adjustment of the offset voltage and current and without causing deterioration of the accuracy. Thus, the present invention can enhance simplification of the circuit formation, noise elimination, reduction of the manufacturing cost and curtailment of the current consumption very much as compared with the conventional system. As a result, the shield case for the circuits which is required in the conventional smoke sensor can be omitted, thereby allowing the apparatus to be small-sized and the manufacturing cost to be reduced. Since the shield case costs about 10% of the manufacturing cost of the entire apparatus, the omission of the shield case can largely contribute to the reduction of the manufacturing cost.

A second embodiment of the present invention will now be described.

Figure 8:
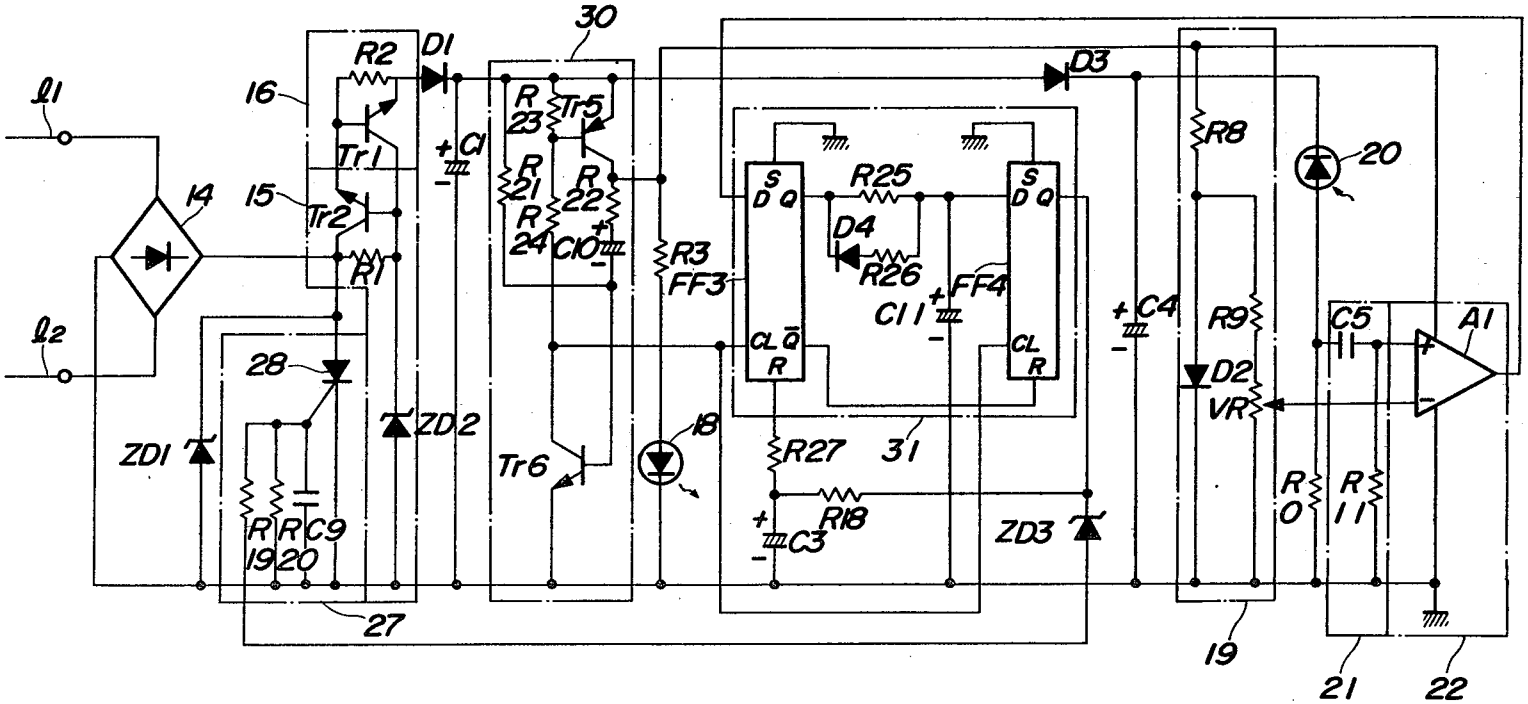
FIG. 8 is a circuit diagram of a second embodiment of a photoelectric smoke sensor according to the present invention.

The smoke sensor of the second embodiment of the present invention as illustrated in FIG. 8 includes a pulse generating circuit which outputs rectangular pulses of a narrow width by given periods for intermittently driving the light emitting diode, the reference voltage setting circuit and the comparator circuit. A clock signal in synchronism with the decay of the rectangular pulse is input to clock terminals of the two-stage D flip-flops which constitutes the storage circuit.

In the circuit arrangement of the second embodiment, the diode bridge circuit 14 is connected to the power and signal lines $\mathbf{1}_1$ and $\mathbf{1}_2$. The output of the diode bridge circuit 14 is connected to the switching circuit 27 having the thyristor 28, the constant voltage circuit 15 having the transistor $Tr_2$, the current limiting circuit 16 having the transistor $Tr_1$ and the zener diode $ZD_1$ for protection from a surge voltage. The output of the current limiting circuit 16 is connected to the electrolytic capacitor $C_1$. This formation is identical with that of the first embodiment. At the stages after the capacitor $C_1$, there are connected, as circuits which are supplied with power from the capacitor $C_1$, a pulse generating circuit, the light emitting diode 18, the reference voltage setting circuit 19, the photo diode 20, the differentiating circuit 21, the comparator circuit 22 and a storage circuit 31. These elements are identical with those of the first embodiment except for the pulse generating circuit 30 and the storage circuit 31.

The pulse generating circuit 30 is comprised of a transistor $Tr_5$ functioning as a switching device, a bias circuit thereof which comprises resistors $R_{23}$ and $R_{24}$, a transistor $Tr_6$ which turns on or off the transistor $Tr_5$ and resistors $R_{21}$ and $R_{22}$ and a capacitor $C_{10}$ for turning on or off the transistor $Tr_6$ by given periods. The resistor $R_{21}$ has a high resistance value, for example, of 4.7MΩ for gradually charging or discharging the capacitor $C_{10}$. The resistor $R_{22}$ has a low resistance value, for example, of 15Ω for rapidly charging the capacitor $C_{10}$ in a polarity as shown. This pulse generating circuit 30 generates outputs from the collectors of the transistors $Tr_5$ and $Tr_6$, respectively. The collector of the former transistor $Tr_5$ is connected, through the resistor $R_3$, to the light emitting diode 18, the reference voltage setting circuit 19 and the power supply terminal of the comparator $A_1$ of the comparator circuit 22. The collector of the latter transistor $Tr_6$ is connected to the clock terminals CL of flip-flops $FF_3$ and $FF_4$ which constitute the storage circuit as will be described in detail later.

The storage circuit 31 is comprised of the two-stage D flip-flops $FF_3$ and $FF_4$. The flip-flops $FF_3$ and $FF_4$ receive at their respective terminals CL, a clock signal from the collector of the transistor $Tr_6$ as described above. A terminal D of the first-stage flip-flop $FF_3$ is connected to the output of the comparator $A_1$. A terminal D of the second-stage flip-flop $FF_4$ is connected, through a resistor $R_{25}$, to a terminal Q of the first-stage flip-flop $FF_3$. A reset terminal R of the flip-flop $FF_4$ is connected to a terminal $\overline{Q}$ of the flip-flop $FF_3$. The resistor $R_{25}$ and a capacitor $C_{11}$ connected to the terminal D of the flip-flop $FF_4$ constitute a storage time prolonging circuit for extending the storage time to 20 to 30 seconds. A terminal Q of the D flip-flop $FF_4$ is connected to the switching circuit 27 through the zener diode for preventing an erroneous operation.

A circuit comprising resistors $R_{18}$ and $R_{27}$ and capacitor $C_3$ and connecting the terminal Q of the second-stage D flip-flop $FF_4$ and the terminal R of the first-stage D flip-flop $FF_3$ is a delay circuit which resets the first D flip-flop $FF_3$ with a delay of predetermined period after the terminal Q of the second-stage flip-flop $FF_4$ has reached an H-level.

The operation of the smoke sensor of the second embodiment will now be described.

In the pulse generating circuit 30, when the transistors $Tr_5$ and $Tr_6$ are in the nonconducting states, the capacitor C10 gradually discharges and is gradually charged from the capacitor $C_1$ through the resistor $R_{21}$. At this time, the polarities of the terminals of the capacitor $C_{10}$ are opposite to those as shown in FIG. 8. When the voltage across the capacitor C10 reaches a predetermined voltage, the transistor $Tr_6$ is turned on. At this time, however, the transistor $Tr_6$ is not completely turned on but it conducts partially. Upon this turning on of the transistor $Tr_6$, the transistor $Tr_5$ is rendered conducting the capacitor C10 is rapidly charged in the polarity as shown in FIG. 8 through the transistors $Tr_5$ and $Tr_6$ and the resistor $R_{22}$. When the voltage developed across the terminals of the capacitor C10 reaches a predetermined value, the transisters $Tr_5$ and $Tr_6$ are turned off. Thus, the pulse generating circuit 30 is restored into the initial state. The slow discharge and charge through the resistor $R_{21}$ and the rapid charge through the transistors $Tr_5$ and $Tr_6$ are repeated alternatingly to obtain pulses of a given period.

Figure 9:
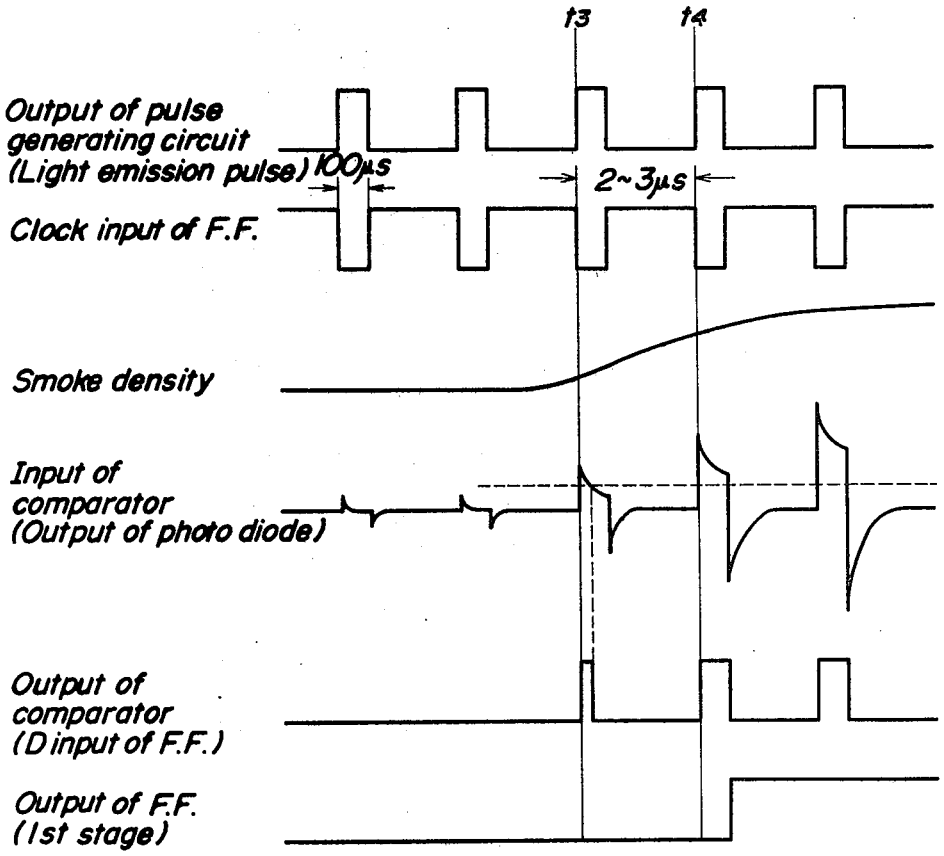
FIG. 9 is a time chart showing the operation of the photoelectric smoke sensor illustrated in FIG. 8.

One of the outputs from the pulse generating circuit 30 is obtained through the collector of the transistor $Tr_5$ whose waveform is shown at the top of FIG. 9. This output is generated during the rapid charge and has a width as narrow as about 100μsec in the present enbodiment. The period is about 2 to 3 sec. Since the circuits of the succeeding stages are directly connected to the capacitor $C_1$ upon conducting of the transistor $Tr_5$, this output supplies large power and intermittently supplies power in the form of pulses to the light emitting diode 18, the reference voltage setting circuit 19 and the comparator A1.

On the other hand, the output from the collector of the transistor $Tr_6$ is opposite in phase to the output obtained from the collector of the transistor $Tr_5$ and used as a clock signal to the D flip-flops $FF_3$ and $FF_4$. This output applies clock signals to the D flip-flops $FF_3$ and $FF_4$ in synchronism with the decay of the light emission output.

The storage circuit 31 reads in data input to the terminal D when the clock signal is input to the terminal CL. In other words, it reads in, at the ending of the light emission of the light emitting diode 18, an output of the comparator A1 which is turned off in synchronism therewith, because, as shown in FIG. 10, the output of the comparator A1 does not immediately become zero but gradually decreases with a certain time constant when the comparator A1 is turned off.

Figure 10:
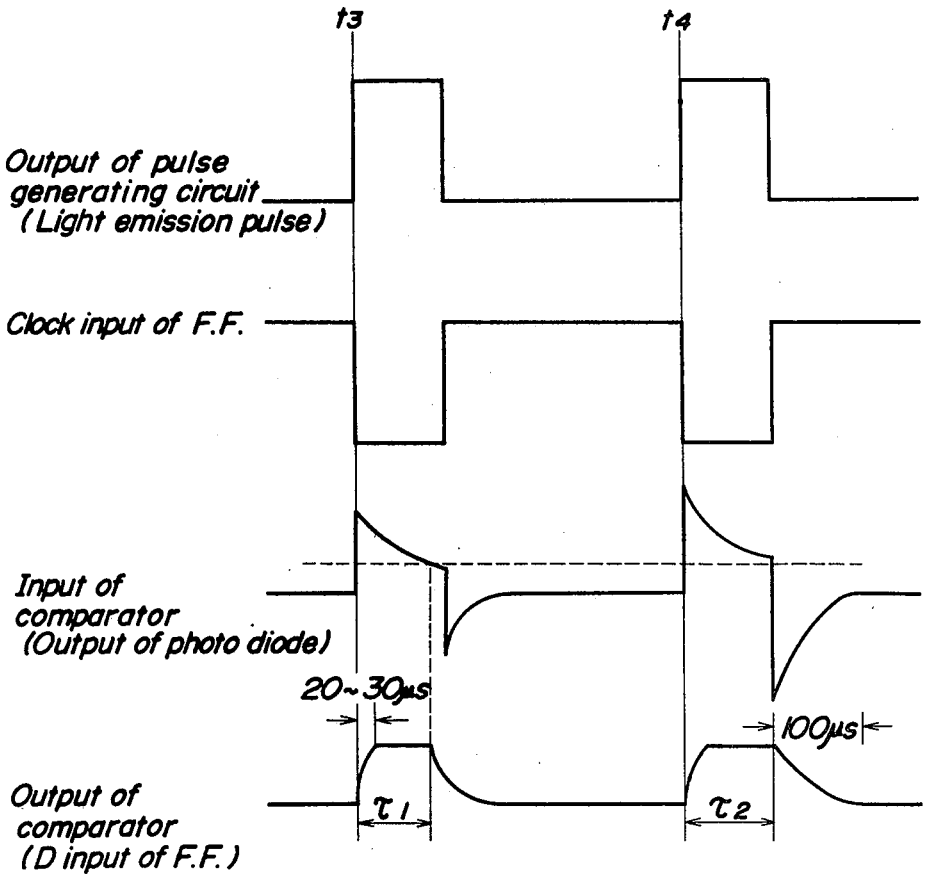
FIG. 10 is an enlarged diagram of part of FIG. 9.

If the smoke density increases around the time $t_3$, the photo output, i.e., the input to the comparator A1 increases as shown in FIGS. 9 and 10. At this time, however, the smoke density is not sufficient and only a part of the input to the comparator A1 exceeds the threshold. Therefore, the pulse width of the output pulse from the comparator A1 is narrow and the output above the predetermined value is not maintained until the rise of the clock input and not read in by the D flip-flop $FF_3$. At the time $t_4$, however, the smoke density reaches the predetermined value, the output of the comparator A1 is maintained higher than the predetermined level and read in by the D flip-flop $FF_3$ to put the terminal Q into an H-level.

Thereafter, the output from this terminal Q is charged in the capacitor C11 through the resistor $R_{25}$ and input to the terminal D of the second-stage D flip-flop FF4 after a given time delay, for example, of 20 to 30 sec and read in when the clock terminal CL receives an input. To maintain the delay, the output from the comparator A1 which is input to the terminal D of the first-stage flip-flop $FF_3$ should be higher than the predetermined value at the times of the input of the all clock signals during this period. If the output is once lowered to below the predetermined value, the terminal Q of the first-stage flip-flop $FF_3$ becomes low and the charge stored in the capacitor C11 is rapidly discharged through the resistor $R_{26}$ and the diode $D_4$. With this arrangement, erroneous fire alarm due to temporary increase in smoke density by smoke from cigarrette etc. is prevented.

When the terminal Q of the second-stage D flip-flop $FF_4$ is put into the H-level, the thyristor 28 of the switching circuit 27 conducts through the zener diode $ZD_3$ for protection against erroneous operation, in the same manner as the first embodiment. Then, the first-stage D flip-flop $FF_3$ is reset after a certain time delay by the delay circuit comprised of the resistors $R_{18}$ and $R_{27}$ and the capacitor $C_3$, and then the second-stage D flip-flop $FF_4$ is reset to put the storage circuit 31 into the initial condition.

The primary advantages of the second embodiment are that the circuit formation is simplified as compared with that of the first embodiment, so that the current consumption is further reduced and the manufacturing cost is further lowered. Another advantage of the second embodiment is that stable reading-in of data is assured because the output from the comparator is read in by the D flip-flop of the storage circuit in synchronism with the decay of the light emission output. More specifically, in the arrangement where the data is read in a certain time delay after the rise of the light emission output, the reading-in time is varied by a change with time or temperature fluctuation in the delay circuit and the reading-in operation cannot always be effected stably. In contrast, according to the present invention, the reading-in time is set as the decay of the light emission output so that the set time is not affected by such a change with time and temperature fluctuation and the reading-in operation can be effected stably.

Although the pulse generating circuit for generating rectangular pulses of narrow width is employed as a means for intermittently driving the light emitting diode, the reference voltage setting circuit and the comparator circuit in the second embodiment, the arrangement of the pulse generating circuit is not limited to the arrangement as illustrated. For example, the oscillator circuit 23, pulse control circuit 24 and light emission driving circuit 17 of the first embodiment may be employed in combination.

Although the light emitting diode is driven directly by the rectangular pulses generated from the pulse generating circuit in the second embodiment, the pulses may be used to drive the light emission driving circuit of the first embodiment for driving, in turn, the light emitting diode.

The storage circuit includes the delay circuit for prolonging the storage time in the second embodiment. However, this delay circuit may be omitted. In this case, the terminal Q of the first-stage D flip-flop may be connected directly to the terminal D of the second stage D flip-flop.

As described above, according to the present invention, the photo diode of low junction capacitance is employed, the resistor having a high resistance value of the order of megohms is connected in series to the photo diode, and the voltage signal appearing at the resistor is input to the comparator circuit through the differentiating circuit, so that the output from the photo diode is directly subjected to the comparison with the reference voltage by the comparator circuit. With this arrangement, first, a high-gain amplifier causing noises can be omitted and accordingly a shield case which is essential in the conventional smoke sensor to eliminate the noises can be omitted. In addition, since the light emitting diode is intermittently driven and the photo output is compared with the reference voltage in synchronism with the light emission by the light emitting diode, the current consumption can be reduced very much. Furthermore, since the high-gain amplifier is not employed, the circuit arrangement can be simplified and the stability of the circuit can be enhanced. Further, in the preferred embodiment illustrated in FIG. 8 wherein a clock signal is applied to the storage circuit to read in the output from the comparator circuit at a timing of decay of the light emission pulse, a circuit such as a delay circuit which sets the reading-in timing based on the time required for the warming-up of the comparator circuit or the amplifier can be omitted. Thus, the circuit arrangement can further be simplified and the current consumption can further be reduced. Moreover, the influence of a change with age or variation in ambient temperature on these circuits can be eliminated to assure a stable reading-in operation.

I claim:

1. A photoelectric smoke sensor, comprising a light emitting diode driven intermittently to emit light and irradiating smoke entering a smoke sensing chamber with pulsed light; a photo diode receiving light scattered by smoke entering the smoke sensing chamber and converting the received light into an electrical signal; a differentiating circuit, and a comparator supplied with power intermittently and in synchronism with the driving of said light emitting diode and receiving and output signal from said photo diode at one input terminal thereof via said differentiating circuit, said comparator receiving a predetermined reference voltage at another input terminal thereof in synchronism with the driving of said light emitting diode and generating an output when an output voltage of the differentiating circuit exceeds said predetermined reference voltage; a latch circuit storing the output from said comparator and generating an output when said comparator, after having been supplied with power on two successive occasions, has generated an output on at least said two successive occasions; and a switching circuit receiving the output from sid latch circuit and actuated thereby to conduct to short-circuit power and signal lines leading to a central signal station whereby a fire signal is transmitted to the central signal station, a resistor, said photo diode having a junction capacitance not exceeding 100 pF and being connected in series with said resistor; a voltage appearing at said resistor forming the output signal from said photo diode and being fed to said comparator via said differentiating circuit; a pulse generating circuit emitting rectangular pulses having a width and a predetermined pulse repetition period to intermittently drive said light emitting diode, a reference voltage setting circuit and said comparator circuit in synchronism with each other; said latch circuit comprising two-stage flip-flop having clock terminals arranged to receive clock signals synchronized with decay of said rectangular pulses; an output of the photo diode being detectable at point of decay of the drive pulse.

2. A photoelectric smoke sensor according to claim 1, wherein said latch circuit comprises a two-stage flip-flop having a first stage and a second-stage, a first terminal of said first-stage being connected to an auxiliary terminal of said second-stage, a second terminal of said first-stage being connected to a reset terminal of said second-stage, an output from said comparator circuit being fed to a second terminal of said first-stage, said switching circuit being activated by an output from said second-stage.

3. A photoelectric smoke sensor according to claim 2, and a storage time prolonging delay circuit connected to said first terminal of said first-stage, said first-stage being gradually charged from said first terminal when said first terminal is at a high-level and being rapidly discharged to said first terminal when said first terminal is at a low level, charged voltage at said storage time prolonging delay circuit being fed to said auxiliary terminal of said second-stage.

4. A photoelectrical smoke sensor according to any one of claims 1 to 3, wherein said photo diode is a PIN type photo diode.

5. A photoelectric smoke sensor according to any one of claims 1 to 3, wherein said reference voltage setting circuit comprises an auxiliary diode with forward voltage and a variable resistor, said reference voltage setting circuit setting said reference voltage by dividing said forward voltage of said auxiliary diode by said variable resistor.

* * * * *